United States Patent [19]

Lytle et al.

[11] 4,136,549

[45] Jan. 30, 1979

[54] ELECTRICAL CABLE CONNECTOR TOOL

[75] Inventors: Thomas G. Lytle; Alajos Z. Bauer, both of Norwalk, Conn.

[73] Assignee: Burndy Corporation, Norwalk, Conn.

[21] Appl. No.: 869,405

[22] Filed: Jan. 16, 1978

[51] Int. Cl.[2] ..... H01R 43/04

[52] U.S. Cl. ..... 72/453.16; 29/751; 29/758; 72/410; 72/412; 81/301

[58] Field of Search ..... 29/751, 753, 758, 252; 72/410, 412, 414–416, 453.15, 453.16; 81/301

[56] References Cited

U.S. PATENT DOCUMENTS 3,030,838 4/1962 Klingler ..... 72/453.16 X

*Primary Examiner*—Carl E. Hall

*Attorney, Agent, or Firm*—Howard S. Reiter

[57] ABSTRACT

This invention relates to tools for installing a connector body on the ends of cable conductors, wherein an indentor head is caused to impinge upon a connector positioned within a compression head to cause connector member to be indented to a desired depth; the device being adaptable to accommodate connector members of varying diameters and to adjust automatically the depth of indentation according to the diameter of the connector being compressed, through operation of differential thread mechanisms connected to a rotatable handle shaft.

28 Claims, 9 Drawing Figures

2
16
18
3
4
4
3
14
10
22
26
12
46
2

46
70
16
49
28
49
18
51
54
50
58
7
60
7
14
72
38
40
10
62
42
44
D
32
28
36
30
20
34
26
46
24
12
22

Fig. 4
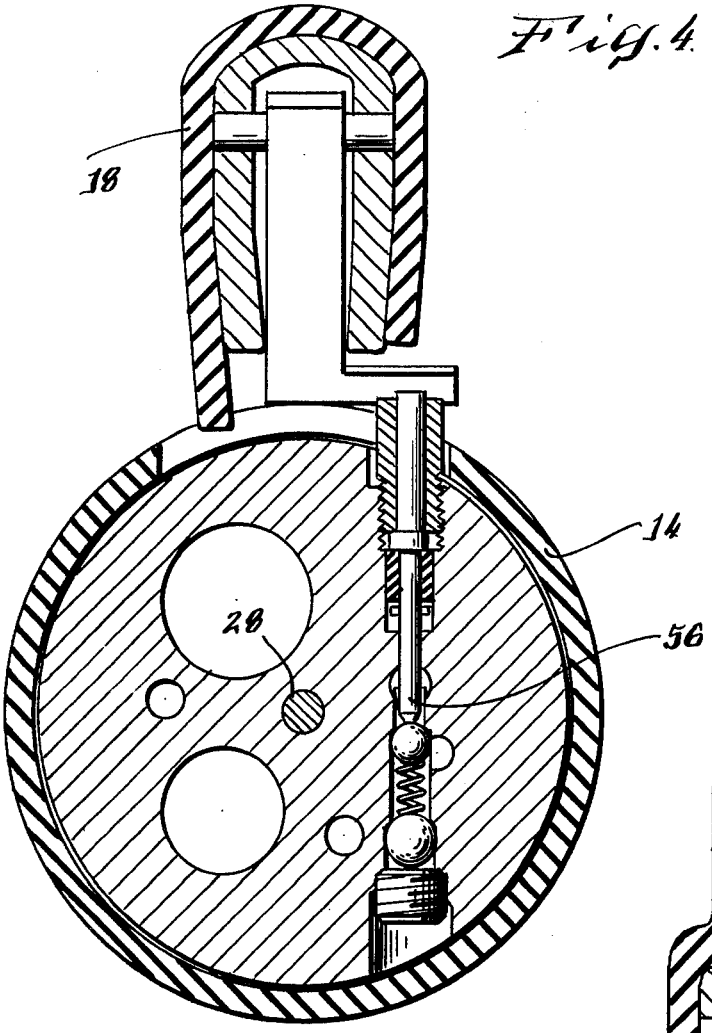
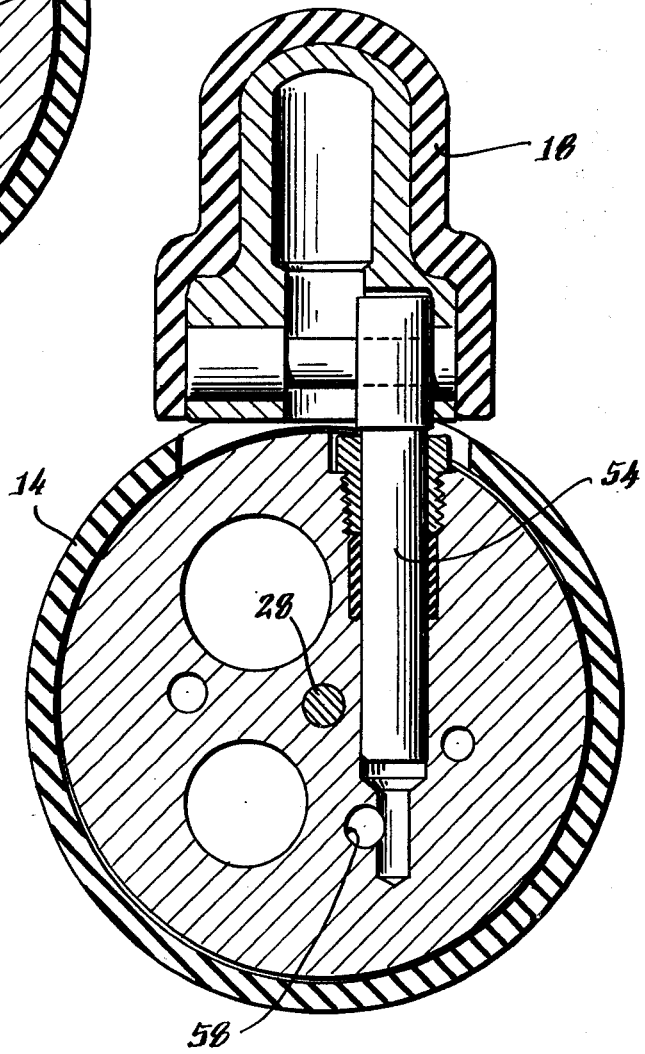
Fig. 3

ELECTRICAL CABLE CONNECTOR TOOL

BACKGROUND OF THE INVENTION

In the field of electrical connectors, and particularly those of larger diameter, it is known to use compression type connectors to connect cable ends so as to effect electrical continuity as well as structural continuity between them. With such devices, the cable ends are inserted into the connector, after which the connector is exteriorly compressed so as to lock the conductor ends together mechanically with electrical continuity therebetween. Particularly with large diameter metallic conductors, the amount of force necessary to effect such a compression connection is very high. Therefore, hydraulically actuated tools have come into use for this purpose. In their simplest form, such tools typically include a compression head, usually in the form of a closed loop forming an aperture into which the connector can be inserted, which aperture is penetrable by a hydraulically actuated indentation or indentor head. In using such devices, the indentor head is positioned on the end of a shaft which may be actuated to move axially by an associated hydraulic system, as for example, through operation of a hand operated pump, causing the indentor head to impinge upon and indent the connector. It has become recognized that such prior art tools are not sufficiently sophisticated, in that they do not permit easy and reliable regulation of the depth of penetration of the indentation; and such lack of control can have deleterious effects on the connector itself and/or the underlying conductors. Various apparatus has been proposed to circumvent such limitations. In this connection reference is made to Dibner U.S. Pat. No. 2,966,192 and the references cited therein.

There is a need, however, for more universally applicable tools which are easily transportable so that they can be used, for example, by electricians working in the field to accommodate connectors of varying sizes and constituent metals, such as aluminum as well as copper, and reliably to reduce the depth of penetration on smaller sized connectors. Therefore there is a need for devices which are universally adaptable to a number of different connector sizes and the dimensional, hardness, and other normal variations of each, while at the same time having the tool so constructed as to vary the depth of penetration in the crimping or indenting operation as a function of the diameter of the connectors being compressed and not as a function of the upper limit of hydraulic or other pressure available to effect such indentation.

Accordingly, it is an object of this invention to provide a means for applying compression connectors which is universally adaptable to a number of different connector sizes.

Another object of this invention is to provide such means wherein the depth of penetration will be adjusted automatically according to the diameter of the connector being applied.

Still another object of this invention is to provide such means in a form that is portable.

Another object of this invention is to provide means for fulfilling the foregoing objectives that is comparatively simple structurally and therefore inexpensive to make operational.

Another object of this invention is to provide a compression connector tool which will accommodate a wide variety of connector sizes and characteristics.

Still another object of this invention is to provide means for carrying out the foregoing objectives in which the depth of indentation does not exceed a desired maximum where hydraulic or other actuating pressure is in excess of that necessary to attain the desired depth of penetration.

SUMMARY OF INVENTION

Desired objectives may be achieved through practice of the present invention which, in one embodiment, includes hydraulically operated cable connector compression apparatus having a central shaft that is rotatable and is threadedly engaged with an indentor means that is adjustable to accommodate connectors of varying sizes in the device as well as being threadedly engaged with means for limiting the depth of indentation which occurs during the compression operation, both of said means being commonly actuated through rotation of the central shaft causing them to move simultaneously in the same direction but over different distances due to their respective thread inter-engagements being at different pitch angles.

DESCRIPTION OF DRAWINGS

This invention may be understood from the description of preferred embodiments which follows, and from the attached drawings, in which FIG. 3 is a cross-section view of the hydraulic pump mechanism taken along line 3—3 of the embodiment shown in FIG. 1, FIG. 4 is a cross-section view of the hydraulic release mechanism taken along line 4—4 of the embodiment shown in FIG. 1.

DESCRIPTION OF PREFERRED EMBODIMENTS

Figure 1:
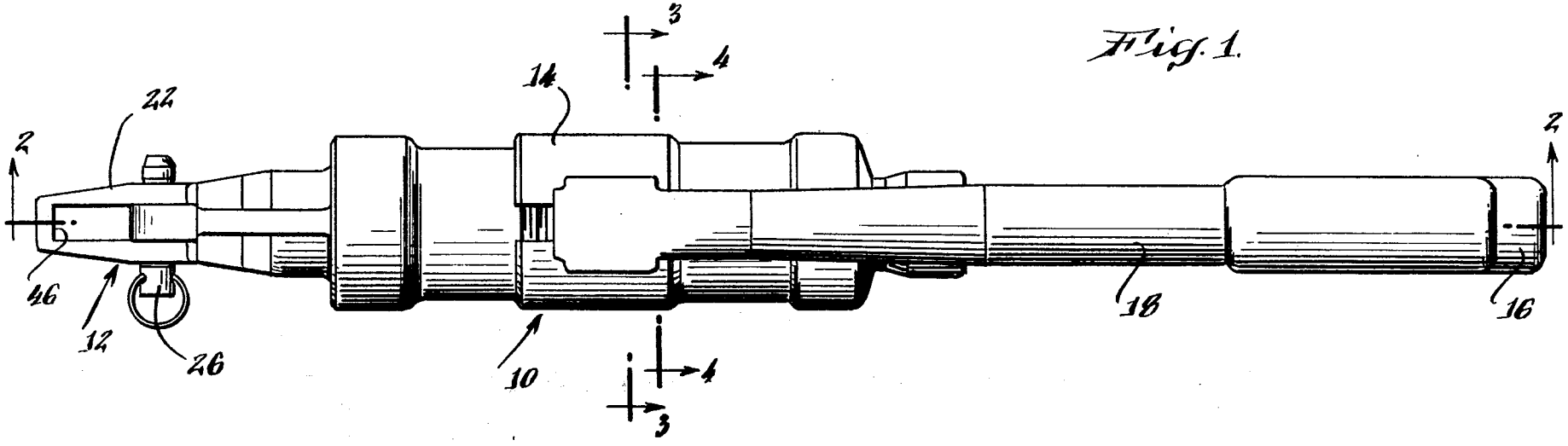
FIG. 1 is a vertical plan view of an embodiment of this invention.
Figure 2:
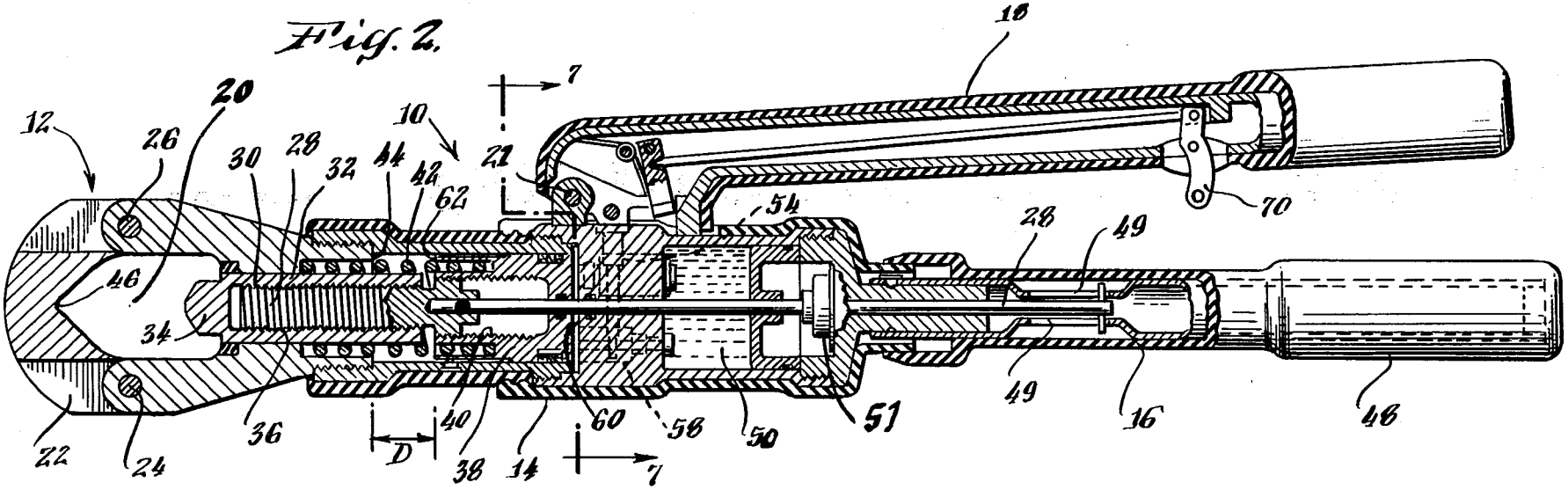
FIG. 2 is a cross-sectional view of the embodiment of this invention shown in FIG. 1 taken along section line 2—2.

Referring first to FIGS. 1 and 2, there is depicted a cable compression connector device 10 comprising a compression head portion 12, a main body portion 14, a handle portion 16, and an associated hydraulic pump handle portion 18. The hydraulic pump handle portion 18 is hinged by a pintle pin 21 so that by opening and closing the handle, pumping means 54 may be actuated to develop pressure in the hydraulic fluid, all in accordance with mechanisms and principals which are known per se. The compression head 12 defines an aperture 20 into which may be inserted connectors to be compressed. To facilitate such insertion, the closed loop of the compression head is formed in part by an end portion 22 which includes a hinge or pintle pin 24 about which the end portion may be swung to open the central aperture 20 by removal of a locking pin 26 positioned on the opposite side of the aperture from the pin 24.

Device 10 further includes a central shaft 28, on the compression head end 30 of which there is positioned a sleeve 32, the end of which, projecting into the aperture 20 in the compression head 12, includes a compression indentor 34. The indentor 34 may be made integral with the sleeve 32 as shown, or may be engageable therewith, as by a threaded connection (not shown), so as to make it replaceable to accommodate breakage or wear, or to accommodate differing indentor cross-sections, without having to disassemble a large part of the device. The sleeve 32 is movably affixed to the shaft 28 by means of the interengagement of a matching set of threads 36 and is keyed against rotation with the shaft 28. Also movably affixed to the shaft 28 is a pillow block 38; the interengagement thereof with the shaft 28 being by means of a second set of interengaging threads 40. The pillow block 38 is also keyed to prevent rotation with the shaft 28. It should be noted that the pillow block, and therefore the entire shaft assembly, is biased away from the head of the compression connector device by means of a spring 42, and that although the sleeve 32 is free to insert progressively into the aperture 20, the pillow block 38 is larger in diameter than is the portion of the interior of the head structure forming a stop 44.

As will be clear from the description which follows, the larger diameter of the pillow block 38, acting in concert with the stop 44, serves to limit the distance by which the pillow block, and therefore the associated shaft 28 and sleeve 32, are able to move axially towards closure between the indentation head 34 and the opposite side 46 of the aperture 20 in the head 12. It will be noted also that the shaft 28 extends from the head end of the device to the rear end where it is movably affixed to the rotatable handle 48 by means of keyways 49, which allow the shaft 28 to move axially while requiring the shaft 28 to rotate with the handle 48. Actuation of the hydraulic mechanism handle 18 draws hydraulic fluid from the hydraulic fluid reservoir 50 and, as is more clearly shown in the known per se pump mechanism 54 illustrated in FIG. 3, moves the fluid under pressure through the internal conduit 58 into the region 60 at the rear of the pillow block 38. By this means, in effect, the pillow block 38 is made to function as a piston in a hydraulic system, and thus can be made to move axially in the direction towards the compression head, causing the indentor 34 and the shaft 28 to move along with it.

The lead (or axial distance over which a single thread makes one 360° revolution) of each of the inter-engaging threads 36 in the first threaded portion, (that is, the one closest to the head) is greater than that of the other threaded portion 40. In other words, the pitch angle of the former is greater than that of the latter. By so selecting the ratio of the pitch of these two threaded segments with respect to each other, it will be apparent that it is possible through rotation of the handle 48 and therefore the shaft 28 to cause the sleeve 32 to move forward (that is, axially toward the head), a greater distance than does the pillow block 38 in response to the same number of shaft revolutions. It will also be apparent that once the shaft rotation has stopped, and the associated hydraulic mechanism is actuated, the distance by which the entire assembly of the shaft 28, the sleeve 32, and the pillow block 38 are able to move axially towards the compression head will be limited by the distance "D" between the connector head end 62 of the pillow block 38 and the stop 44 at the base of the connector head. The amount of this distance "D" will be a fixed fraction of the amount of travel potential of the indentor 34; the fraction being a function of the ratio of the migration of the first threaded section 36 as a result of shaft 28 rotation, to that of the second threaded section 40.

Figure 5:
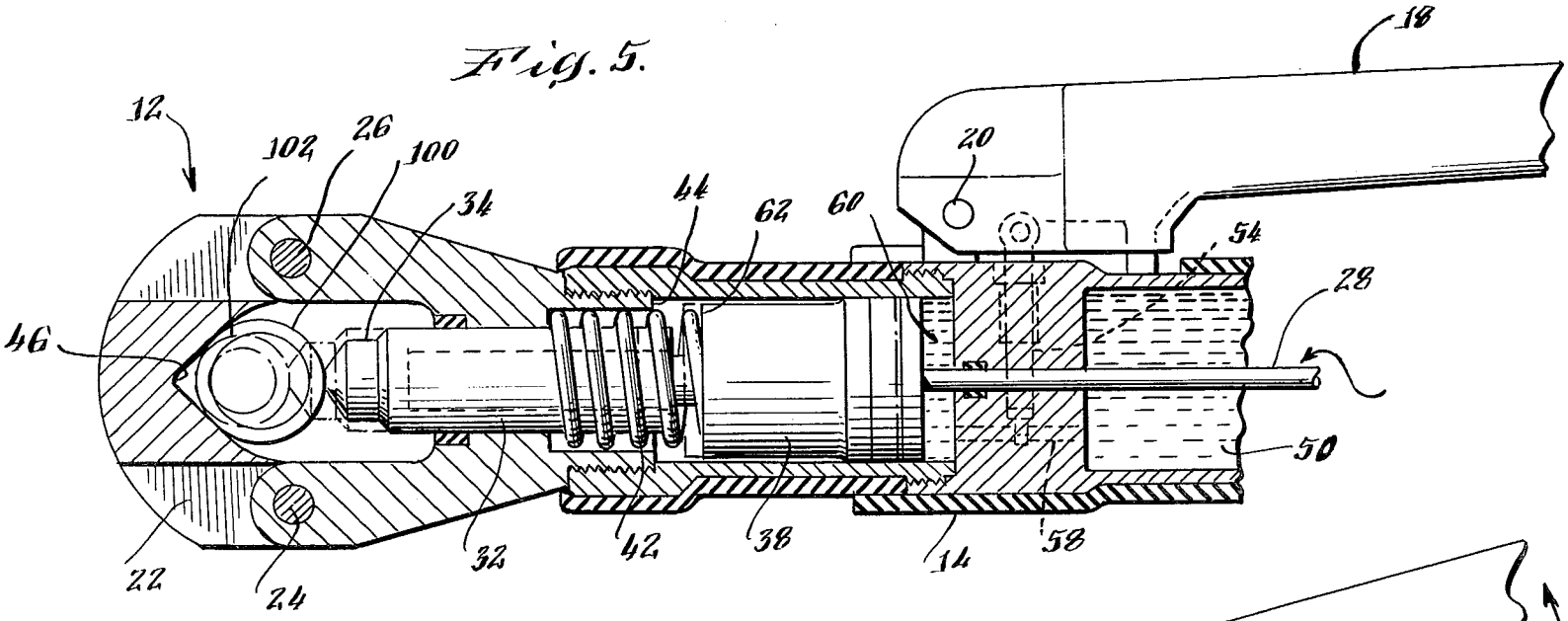
FIG. 5 is a cross-sectional view of a portion of the embodiment shown in FIG. 1 at a first stage of operation.

In operation, this device works as follows. A compression connector to be compressed is inserted in the aperture 20, the handle 48 is then turned until the indentor head 34 just touches the outside of the compression connector, the other side of which is supported by the wall 46 of the aperture 20 opposite the indentor head 34. These relationships are shown in FIG. 5, which illustrates the relative position of these various components when adjusted to accommodate a large connector 100 (the indentor head and pillow block position being illustrated in solid outlines), and a small connector 102 (the indentor and pillow block positions being illustrated in dashed lines).

Figure 6:
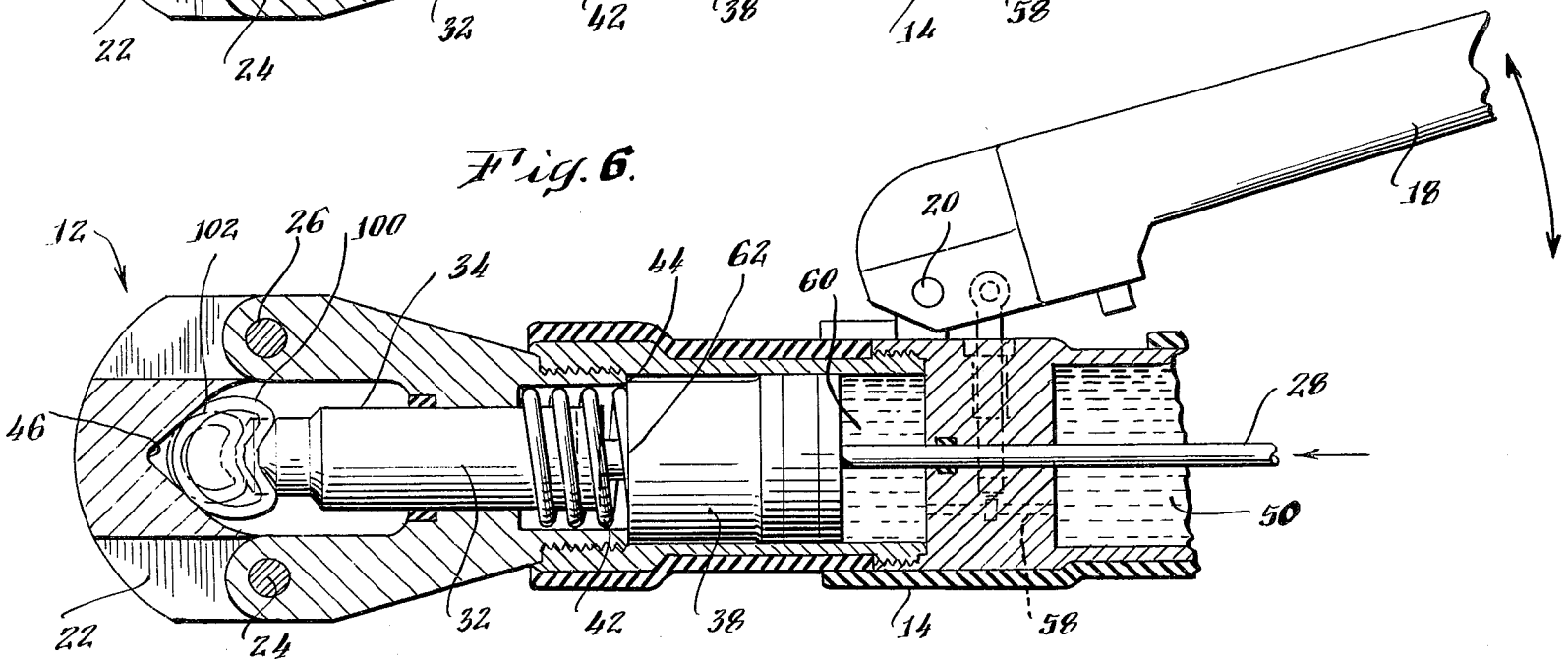
FIG. 6 is a cross-sectional view of the portion shown in FIG. 5 at a second stage of operation.

At this point, the pillow block 38, also having moved forward concurrently with the movement forward of the sleeve 32 (i.e., axially towards the head), the hydraulic handle 18 may be raised and lowered causing hydraulic fluid flowing from the reservoir 50 to be forced under high pressure in the region 60 at the end of the pillow block 38 away from the head, causing the interconnected assembly of the pillow block 38 and the sleeve 32, along with the shaft 28, to move forward, to the point where the end 62 of the pillow block 38 abuts the stop 44. These interrelationships are shown in FIG. 6, which illustrates the relative positions of these various components when the indentor head is in the deepest point of indentation; the indentor head position being shown by solid lines as to the larger connector 100 and by dashed lines as to the small connector 102, and the pillow block position being shown by solid lines as to both the large connector 100 and the small connector 102.

At this point any additional introduction of hydraulic fluid, or any raising of pressure in the end region 60 of the pillow block 38, will not produce any further motion of the indentor head 34 into the compression connector, but, instead, by means of known per se relief by-pass mechanisms, (not shown) any additional pressurized hydraulic fluid will be returned to the reservoir 50. Hydraulic fluid under pressure at the end region 60 adjacent the pillow block 38, may then be released by operation of trigger mechanism 70 on the hydraulic handle 18 with associated known per se relief releasing such as that shown in FIG. 4, in response to which the bias spring 42 will force the pillow block-sleeve-shaft assembly back (that is, axially away from the compression connector head), drawing the indentor head 34 out of the indenting position, back to its original pre-set position.

Applying the foregoing principals, it will be seen from the example which follows, that it is possible to accommodate a wide variety of connector sizes and to cause indentation of them which is directly proportional in depth to the diameter of the connector being installed. Thus, in one embodiment, the threaded section associated with the indentor sleeve (that is, the threaded section engaging this sleeve with the shaft) being the thread closer to the compression head, was made with a pitch lead length of 0.163 inches, while the other threaded section (that is the one between the pillow block and the shaft), was made with a pitch lead length of 0.1 inches. The distance "D" between the pillow block and the travel stop at the base of the compression head was designed for a maximum displacement of 0.675 inches. With the pillow block-shaft-sleeve assembly in the fully withdrawn position, the distance between the outermost end of the indentor (that is, the one extending furthest into the compression head aperture) and the wall of the aperture opposite the indentor was designed to be 1.75 inches.

Referring now to the table below, the first column lists conductor sizes and (by the designations A for aluminum and C for copper) the constituent material from which the conductor is made. The next column indicates the outside diameter of the compression connector that is to be utilized in conjunction with the designated conductors. The third column, captioned "G," indicates the distance between the end of the indentor head and the opposite side of the head aperture at the point where adjustment of the indentor head is to be stopped and actuation of the hydraulic system is to begin. The column captioned "R" indicates the distance travelled axially by the indentor head through rotation of the adjustor handle to the point where hydraulic actuation is to commence. The column captioned "D" indicated the distance which will be travelled by the pillow block-shaft-indentor sleeve assembly upon actuation of the hydraulic system, between the point of positioning the indentor head at the desired location and the point where the head end of the pillow block comes in contact with the travel stop at the base of the head assembly. It will be apparent that from this last column in particular that the depth of indentation in a given connector will be the distance "D."

| CONNECTOR SIZE | DIAMETER | G | R | D |
|---|---|---|---|---|
| 750 A | 1.600 | 1.750 | 0 | .675 |
| 750 A | 1.460 | 1.600 | .150 | .617 |
| 750 A | 1.300 | 1.440 | .310 | .555 |
| 600 C | 1.188 | 1.320 | .430 | .509 |
| 500 C | 1.060 | 1.190 | .560 | .459 |
| 400 C | .953 | 1.070 | .680 | .413 |
| 350 C | .875 | .990 | .760 | .382 |
| 300 C | .813 | .910 | .840 | .351 |
| 250 C | .750 | .850 | .900 | .328 |
| 4/0 C | .688 | .770 | .980 | .297 |
| 2/0 C | .563 | .670 | 1.080 | .258 |
| 1/0 C | .513 | .560 | 1.190 | .126 |
| #2 C | .415 | .440 | 1.310 | .170 |
| #4 C | .340 | .350 | 1.400 | .135 |
| #6 C | .292 | .292 | 1.458 | .113 |

Thus, it will be apparent that through utilization of devices made in accordance with the teachings of this invention, it is possible to adjust the device so as to accommodate a wide variety of connector sizes, and simultaneously therewith, to accommodate the need for varying indentation depths as a function of the diameter of the connector being applied.

Figure 7:
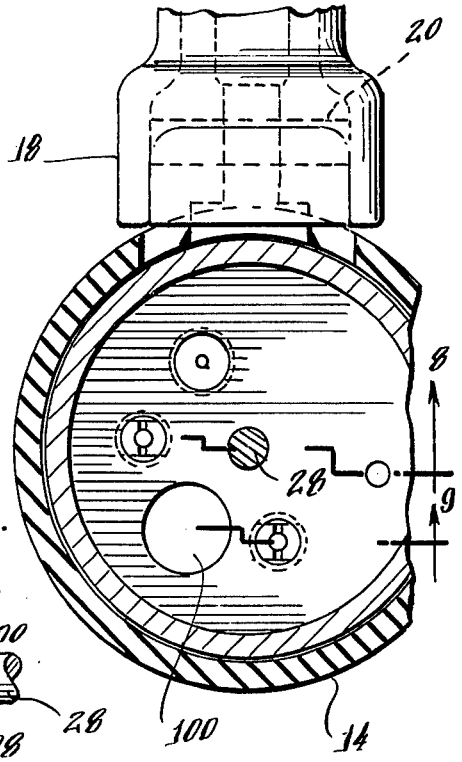
FIG. 7 is a cross-sectional view of the embodiment of this invention taken along lines 7—7 of FIG. 2.

FIG. 7 is a section taken along the line 7—7 as shown in FIG. 2, i.e., substantially at the base of the cavity in which the pillow block 38 is positioned. FIG. 7 includes Section Line 8—8 and 9—9, which are the planes along which FIGS. 8 and 9 respectively are illustrated.

Figure 9:
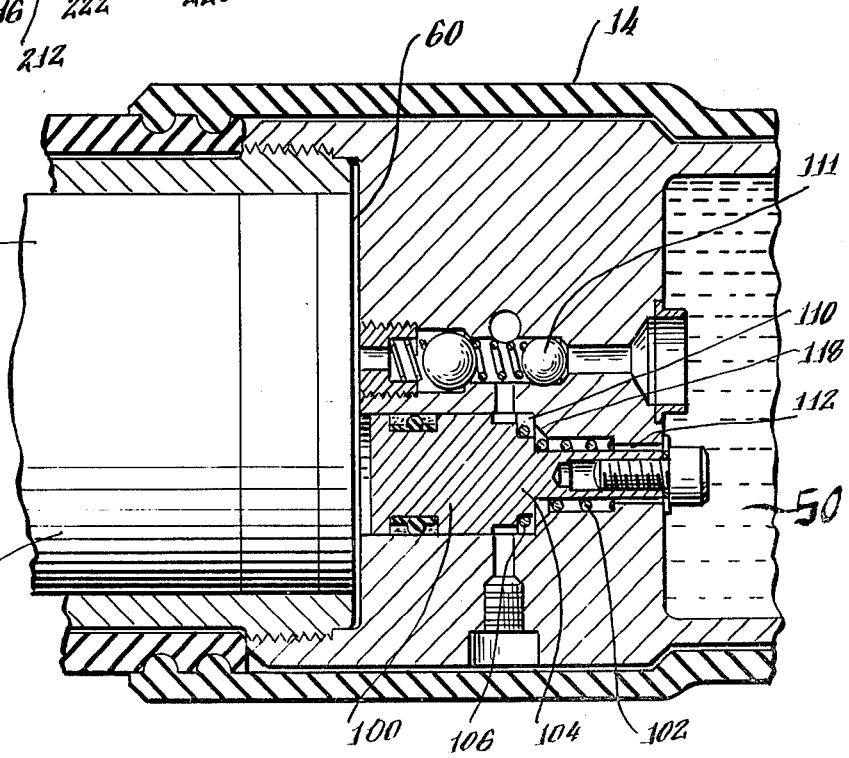
FIG. 9 is a cross-sectional view of a setting sensor mechanism taken along lines 9—9 in FIG. 7.

The portion of the apparatus shown in FIG. 9 is designed to ensure against an operator of the tool inadvertently, prematurely stopping insertion of the indentor head, as a result of which subsequent actuation of the hydraulic system, or other shaft actuator mechanism, might result in inadequate indentation of the cable connector.

As illustrated, it will be noted that a secondary piston 100 is free to move backward and forward, but is normally biased toward the pillow block 38 by means of a spring 102 or other biasing means. At the opposite end 104 of the piston 100 is positioned an O-ring 106 or other sealing means, designed to effect sealing inter-engagement with a corresponding surface 118 in the piston chamber 110 when the piston 100 is moved as far as possible in the direction away from the pillow block 38. It will be noted that until the piston 100 is so positioned in the seated position, hydraulic fluid being propelled by the pump 54, will pass through the region 110 between the end 104 of the piston and the piston chamber surface 118, through the conduit 112, and back into the hydraulic fluid reservoir 50. When the shaft 28 has been moved axially forward by a distance sufficient for the indentor head 34 to have come in contact with the outside of the connector which it is to indent, further rotation of the shaft 28, with concurrent blocking of forward motion of the indentor 34 by virtue of the presence of the connector body, will produce a net backward (i.e., toward the handle 16) motion of the pillow block 38. To assist the concurrent backward motion of the shaft 28, the retainer 51 may include a Belleville washer or other member (not shown) to permit movement of the shaft 28 relative to the retainer 51. This causes a pressure rise in the hydraulic fluid occupying the space 60 sufficient to cause the piston 100 to move away from the direction of the pillow block 38 into the sealing position (i.e., so that the piston end 104 presses against the surface 118, causing the sealing means 106 to close off the flow path through the region 110 and the conduit 112). Following this, continued actuation of the hydraulic pump 54 will cause the indentor head 34 to perform the desired indenting operation. Subsequent to pressurizing of the hydraulic system, as by actuation of the release trigger 70 with resulting actuation of its associated valving 56 and return of the pillow block-shaft-sleeve structure to its original position through operation of the biasing spring 42, the piston 100 is permitted to return to its original position, reopening the by-pass flow path through the region 110 and the conduit 112.

Figure 8:
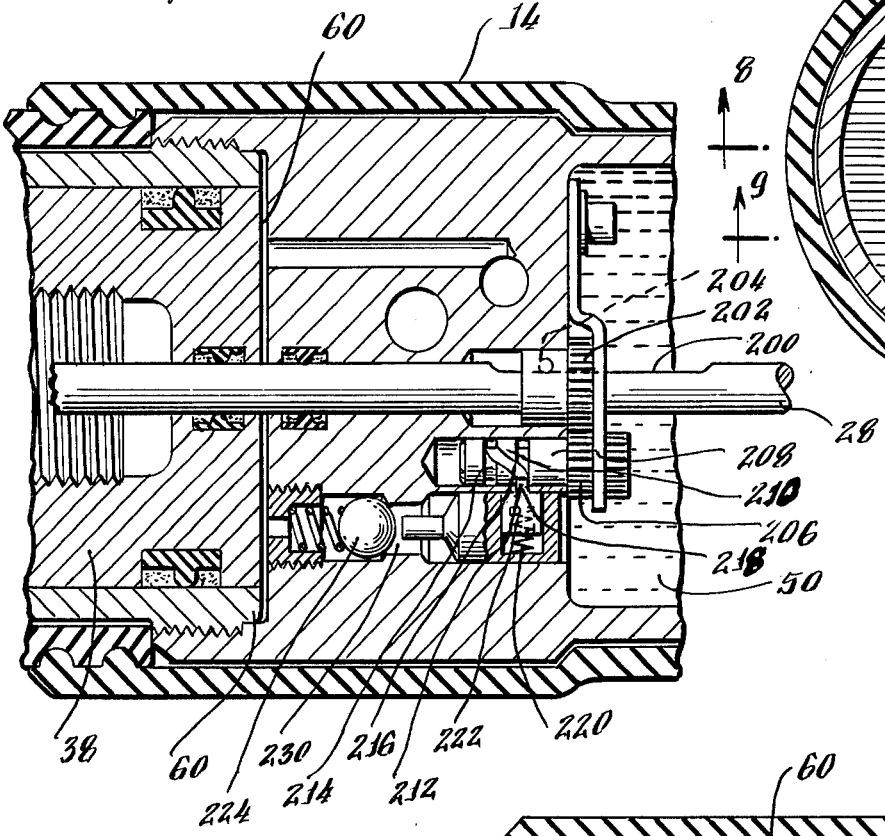
FIG. 8 is a cross-sectional view of a reset mechanism taken along lines 8—8 in FIG. 7.

FIG. 8 illustrates a portion of the mechanism designed to preclude the tool operator from introducing changes in the desired ratio between the preindentation positioning of the indentor head (corresponding to the connector diameter) and the axial displacement potential of the pillow block-shaft-sleeve construction as limited by the gap between the pillow block and the associated stop 44 (i.e., the indentation depth for connectors of this diameter). Such ratio changes are possible with the embodiment hereinbefore described, if, for example, the handle 16 is rotated counterdirectionally (i.e., in the direction to withdraw the indentor head from the aperture 20), without the pressure release trigger 70 and its associated mechanism having been actuated. By virtue of the hydraulic fluid not being able to escape from the region of the end of the pillow block away from the compression head (i.e., from the region 60), the pillow block is held against moving back away from the compression head, so that the rotating shaft 28 which, by virtue of its threaded inter-engagement with the pillow block 38, must move axially relative to the pillow block, can only move toward the compression head. However, at the same time, the sleeve 32 continues to move axially with respect to the shaft but counter-directionally thereto. Thus, when the process has been completed, the setting indentation ratios will have been altered from the desired ones originally established because the relative positions of the sleeve 32 and the pillow block 38 in the shaft 28 will have changed.

FIG. 8 illustrates mechanism designed to preclude this from happening. As illustrated, the shaft 28 has a flat portion 200 on which is positioned a gear 202, affixed thereto by means of a pin 204. The gear 202 is meshed with another gear 206 affixed to the end of a shaft 208 on the end of which is a cam 210. The cam 210 has circular end grooves 212, 214, interconnected by a helical groove 216, in one of which grooves, at any given point in time, there rides the pin 218 of a cam rider 220. The pin 218 is biased toward the base of the groove in which it rides by means of a biasing spring 222. The end groove 214 has a base which drops sharply at a notch facing in the direction in which the helical groove 216 enters the end groove 214 at the point of such entry; the base of the end groove 214 at the base of the notch being at the same level as the base of the helical groove 216 at that point. By this means, the pin 218, being forced toward the groove by means of the bias spring 222, will be caused to stay in the end groove 216 so long as the cam is rotating in the direction away from that at which the helical groove 216 enters the end groove 214. However, when the cam 210 reverses direction, it will cause the pin 218 to follow the helical groove 216 back into the end groove 212. A similar notch arrangement obtains with respect to the intersection of the helical groove 216 with the end groove 212, for the purpose of ensuring that the pin will enter the helical groove 216 so as to pass into the end groove 214 when the direction of rotation of the cam 210 is again reversed.

The cam rider 220 is designed to move backward and forward, into and out of engagement with a valving mechanism 224, so as to cause it to open and close a flow path 230 between the hydraulic fluid reservoir 50 and the region 60 adjacent to the end of the pillow block 38 facing away from the compression head.

In operation, when the tool operator turns the handle 16, and therefore the shaft 28, in the direction to effect thrusting the indentor head 34 into the compression head aperture 20 (e.g., clockwise), the gears 202, 206 will cause the cam 210 to make the cam pin 218 and its associated cam rider 220 to move away from the valve 224, causing the valve 224 to close so that the flow path 230 is not open to by-passing of fluid back to the reservoir 50. It should be noted that the valve 224 is really basically a check-valve, and therefore that it will, however, permit fluid flow from the reservoir. However, when the handle 16 and shaft 28 are rotated in the opposite direction (i.e., counter-clockwise, in this example), the pin 218 will fall into the helical groove 216 and force the cam rider 220 into engagement with the valve 224, allowing it to open the flow path back to the reservoir 50, thus ensuring that the heretofore-described blockage of the pillow block 38, with consequent alteration of the setting-indentation ratios, will not occur because the operator has neglected to actuate the release trigger 70 and its associated mechanism 56.

It is to be understood that various substitutions may be made in the foregoing description. Thus, although a hydraulic actuation system has been described, it would be feasible and within the contemplation of this invention to use a pneumatic system or even a mechanical system such as one that is ratchet actuated, according to principles that are well known in the art in the practice of the present invention. It will also be obvious that the exact configurations of the constituent parts associated with the threaded mechanisms might be varied or reversed, again without departing from the present teachings. Accordingly, it is to be understood that the foregoing descriptions are by way of illlustration and not of limitation and that a wide variety of embodiments may be made without departing materially from the spirit or scope of this invention.

I claim:

1. A device for compressing electrical connectors comprising a main body having positionally fixed with respect thereto a compression head for receiving connector bodies to be subjected to compression, a compression indentor positioned within an aperture forming the connector receiving portion of said compression head, said indentor being located at the end of an associated sleeve which is interconnected to one end of an axially movable, rotatable shaft which has two intermediate, axially displaced threaded portions, the threads of which are oriented in the same direction, the lead of the threads of the first threaded portion closest to the head being greater than those of the other threaded portion and being threadedly interengaged with corresponding threads in said associated sleeve, said sleeve being positioned fixed with respect to said main body against rotation when said shaft is rotated, the other of said threaded portions being threadedly interengaged with corresponding threads of a pillow block which surrounds and is coaxial with said shaft, said pillow block being positionally fixed with respect to said main body against rotating when said shaft is rotated, said pillow block being normally biased against axial movement in the direction of said head by bias means and including stop means cooperatively interengageable with corresponding stop means positionally fixed with respect to said head so as to limit the distance by which said pillow block can move axially in the direction of said head, whereby through rotation of said shaft, and as a result of the lead differential between the said threaded portions, said compression indentor will be moved into said compression head to a desired extent, with corresponding relative motion of said pillow block towards said head and consequent shortening of the distance between both of the aforesaid stop means reducing the distance by which said shaft is free to move said indentor into said aperture of said head in response to application of axial force movements to said shaft toward said head.

2. The device described in claim 1 including means for causing said shaft and thereby concurrently said sleeve and said pillow block, to be actuated so as to move axially toward said head.

3. The device described in claim 2 wherein said actuating means is a hydraulic system wherein said pillow block also serves as the piston of said hydraulic system by which actuation of said system causes axial motion of said shaft.

4. The device described in claim 2 wherein said corresponding threads to those of said first portion are integral with a sleeve on which said indentor is positioned.

5. The device described in claim 3 wherein said corresponding threads to those of said first portion are integral with a sleeve on which said indentor is positioned.

6. The device described in claim 1 wherein said pillow block is biased against axial movement towards said head by means of a spring.

7. The device described in claim 2 wherein said pillow block is biased against axial movement towards said head by means of a spring.

8. The device described in claim 3 wherein said pillow block is biased against axial movement towards said head by means of a spring.

9. The device described in claim 8 wherein the ratio of the lead of said first threaded portion to that of said other threaded portion is approximately 1.63 to 1, the clearance between the indentor when in the fully open position and the opposite side of the head aperture into which it extends at least 1.750 inches (4.45 cm), and the shaft stroke which can be actuated hydraulically when the pillow block is so positioned that its said stop means and the stop means associated with it are furthest apart is substantially 0.675 inches (1.71 cm) when said clearance between said indentor and said opposite side of said aperture is substantially 1.750 inches (4.45 cm).

10. The device described in claim 2 wherein the ratio of the lead of said first threaded portion to that of said other threaded portion is approximately 1.63 to 1, the clearance between the indentor when in the fully open position and the opposite side of the head aperture into which it extends at least 1.750 inches (4.45 cm), and the shaft stroke which can be actuated hydraulically when the pillow block is so positioned that its said stop means and the stop means associated with it are furthest apart is substantially 0.675 inches (1.71 cm) when said clearance between said indentor and said opposite side of said aperture is substantially 1.750 inches (4.45 cm).

11. The device described in claim 3 wherein the ratio of the lead of said first threaded portion to that of said other threaded portion is approximately 1.63 to 1, the clearance between the indentor when in the fully open position and the opposite side of the head aperture into which it extends at least 1.750 inches (4.45 cm), and the shaft stroke which can be actuated hydraulically when the pillow block is so positioned that its said stop means and the stop means associated with it are furthest apart is substantially 0.675 inches (1.71 cm) when said clearance between said indentor and said opposite side of said aperture is substantially 1.750 inches (4.45 cm).

12. The device described in claim 4 wherein the ratio of the lead of said first threaded portion to that of said other threaded portion is approximately 1.63 to 1, the clearance between the indentor when in the fully open position and the opposite side of the head aperture into which it extends at least 1.750 inches (4.45 cm) and the shaft stroke which can be actuated hydraulically when the pillow block is so positioned that its said stop means and the stop means associated with it are furthest apart is substantially 0.675 inches (1.71 cm) when said clearance between said indentor and said opposite side of said aperture is substantially 1.750 inches (4.45 cm).

13. The device described in claim 5 wherein the ratio of the lead of said first threaded portion to that of said other threaded portion is approximately 1.63 to 1, the clearance between the indentor when in the fully open position and the opposite side of the head aperture into which it extends at least 1.750 inches (4.45 cm) and the shaft stroke which can be actuated hydraulically when the pillow block is so positioned that its said stop means and the stop means associated with it are furthest apart is substantially 0.675 inches (1.71 cm) when said clearance between said indentor and said opposite side of said aperture is substantially 1.750 inches (4.45cm).

14. The device described in claim 6 wherein the ratio of the lead of said first threaded portion to that of said other threaded portion is approximately 1.63 to 1, the clearance between the indentor when in the fully open position and the opposite side of the head aperture into which it extends at least 1.750 inches (4.45 cm) and the shaft stroke which can be actuated hydraulically when the pillow block is so positioned that its said stop means and the stop means associated with it are farthest apart is substantially 0.675 inches (1.71 cm) when said clearance between said indentor and said opposite side of said aperture is substantially 1.750 inches (4.45 cm).

15. The device described in claim 7 wherein the ratio of the lead of said first threaded portion to that of said other threaded portion is approximately 1.63 to 1, the clearance between the indentor when in the fully open position and the opposite side of the head aperture into which it extends at least 1.750 inches (4.45 cm) and the shaft stroke which can be actuated hydraulically when the pillow block is so positioned that its said stop means and the stop means associated with it are furthest apart is substantially 0.675 inches (1.71 cm) when said clearance between said indentor and said opposite side of said aperture is substantially 1.750 inches (4.45 cm).

16. The device described in claim 8 wherein the ratio of the lead of said first threaded portion to that of said other threaded portion is approximately 1.63 to 1, the clearance between the indentor when in the fully open position and the opposite side of the head aperture into which it extends at least 1.750 inches (4.45 cm) and the shaft stroke which can be actuated hydraulically when the pillow block is so positioned that its said stop means and the stop means associated with it are furthest apart is substantially 0.675 inches (1.71 cm) when said clearance between said indentor and said opposite side of said aperture is substantially 1.750 inches (4.45 cm).

17. The device described in claim 3 including means for causing hydraulic fluid introduced into the region of said pillow block to bypass back into a reservoir of said hydraulic system when said indentor head has not come into contact with a solid object positioned within said aperture in contact with the wall of said head opposite said indentor, and for causing such fluid to be trapped within said region so that the further introduction of hydraulic fluid therein causes an increase of pressure thereby upon said pillow block when said indentor has come into contact with a solid object so positioned.

18. The device described in claim 5 including means for causing hydraulic fluid introduced into the region of said pillow block to bypass back into a reservoir of said hydraulic system when said indentor head has not come into contact with a solid object positioned within said aperture in contact with the wall of said head opposite said indentor, and for causing such fluid to be trapped within said region so that the further introduction of hyraulic fluid therein causes an increase of pressure thereby upon said pillow block when said indentor has come into contact with a solid object so positioned.

19. The device described in claim 8 including means for causing hydraulic fluid introduced into the region of said pillow block to bypass back into a reservoir of said hydraulic system when said indentor head has not come into contact with a solid object positioned within said aperture in contact with the wall of said head opposite said indentor, and for causing such fluid to be trapped within said region so that the further introduction of hydraulic fluid therein causes an increase of pressure thereby upon said pillow block when said indentor has come into contact with a solid object so positioned.

20. The device described in claim 11 including means for causing hydraulic fluid introduced into the region of said pillow block to bypass back into a reservoir of said hydraulic system when said indentor head has not come into contact with a solid object positioned within said aperture in contact with the wall of said head opposite said indentor, and for causing such fluid to be trapped within said region so that the further introduction of hydraulic fluid therein causes an increase of pressure thereby upon said pillow block when said indentor has come into contact with a solid object so positioned.

21. The device described in claim 13 including means for causing hyraulic fluid introduced into the region of said pillow block to bypass back into a reservoir of said hydraulic system when said indentor head has not come into contact with a solid object positioned within said aperture in contact with the wall of said head opposite said indentor, and for causing such fluid to be trapped within said region so that the further introduction of hydraulic fluid therein causes an increase of pressure thereby upon said pillow block when said indentor has come into contact with a solid object so positioned.

22. The device described in claim 16 including means for causing hydraulic fluid introduced into the region of said pillow block to bypass back into a reservoir of said hydraulic system when said indentor head has not come into contact with a solid object positioned within said aperture in contact with the wall of said head opposite said indentor, and for causing such fluid to be trapped within said region so that the further introduction of hydraulic fluid therein causes an increase of pressure thereby upon said pillow block when said indentor has come into contact with a solid object so positioned.

23. The device described in claim 3 including valve means, in addition to the pressure release means normally associated with hydraulic mechanisms, for causing an associated bypass path between the region of the end of said pillow block and said reservoir to be opened to the flow of hydraulic fluid therethrough in response to said handle being rotated in the direction which will cause said indentor head to move out of said aperture, and will cause said bypass path to be clear to the passage of hydraulic fluid therethrough in response to said handle being rotated in the opposite direction.

24. The device described in claim 5 including valve means, in addition to the pressure release means normally associated with hydraulic mechanisms, for causing an associated bypass path between the region of the end of said pillow block and said reservoir to be opened to the flow of hydraulic fluid therethrough in response to said handle being rotated in the direction which will cause said indentor head to move out of said aperture, and will cause said bypass path to be clear to the passage of hydraulic fluid therethrough in response to said handle being rotated in the opposite direction.

25. The device described in claim 8 including valve means, in addition to the pressure release means normally associated with hydraulic mechanisms, for causing an associated bypass path between the region of the end of said pillow block and said reservoir to be opened to the flow of hydraulic fluid therethrough in response to said handle being rotated in the direction which will cause said indentor head to move out of said aperture, and will cause said bypass path to be clear to the passage of hydraulic fluid therethrough in response to said handle being rotated in the opposite direction.

26. The device described in claim 11 including valve means, in addition to the pressure release means normally associated with hydraulic mechanisms, for causing an associated bypass path between the region of the end of said pillow block and said reservoir to be opened to the flow of hydraulic fluid therethrough in response to said handle being rotated in the direction which will cause said indentor head to move out of said aperture, and will cause said bypass path to be clear to the passage of hydraulic fluid therethrough in response to said handle being rotated in the opposite direction.

27. The device described in claim 13 including valve means, in addition to the pressure release means normally associated with hydraulic mechanisms, for causing an associated bypass path between the region of the end of said pillow block and said reservoir to be opened to the flow of hydraulic fluid therethrough in response to said handle being rotated in the direction which will cause said indentor head to move out of said aperture, and will cause said bypass path to be clear to the passage of hydraulic fluid therethrough in response to said handle being rotated in the opposite direction.

28. The device described in claim 16 including valve means, in addition to the pressure release means normally associated with hydraulic mechanisms, for causing an associated bypass path between the region of the end of said pillow block and said reservoir to be opened to the flow of hydraulic fluid therethrough in response to said handle being rotated in the direction which will cause said indentor head to move out of said aperture, and will cause said bypass path to be clear to the passage of hydraulic fluid therethrough in response to said handle being rotated in the opposite direction.

* * * * *